US009340012B2

(12) United States Patent
Araki et al.

(10) Patent No.: US 9,340,012 B2
(45) Date of Patent: May 17, 2016

(54) IMAGE FORMING APPARATUS AND METHOD OF DRIVING LIQUID EJECTING HEAD

(71) Applicants: Satomi Araki, Kanagawa (JP); Takahiro Yoshida, Kanagawa (JP)

(72) Inventors: Satomi Araki, Kanagawa (JP); Takahiro Yoshida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/165,863

(22) Filed: Jan. 28, 2014

(65) Prior Publication Data

US 2014/0218428 A1 Aug. 7, 2014

(30) Foreign Application Priority Data

Feb. 6, 2013 (JP) ..... 2013-021835

(51) Int. Cl.
*B41J 2/045* (2006.01)

(52) U.S. Cl.
CPC ..... *B41J 2/04588* (2013.01); *B41J 2/04553* (2013.01); *B41J 2/04571* (2013.01); *B41J 2/04581* (2013.01); *B41J 2/04595* (2013.01); *B41J 2/04596* (2013.01)

(58) Field of Classification Search
CPC ..... B41J 2/04596; B41J 2/04598; B41J 2/04541; B41J 2/04581
See application file for complete search history.

(56) References Cited

U.S. PATENT DOCUMENTS

2004/0223027 A1* 11/2004 Shinkawa et al. ..... 347/23
2008/0100653 A1* 5/2008 Zhang ..... 347/11
2011/0090273 A1* 4/2011 Miyazaki ..... B41J 2/04553 347/10
2011/0175956 A1* 7/2011 Tsukamoto ..... B41J 2/04581 347/10
2011/0205273 A1* 8/2011 Hibino ..... B41J 2/04581 347/10

FOREIGN PATENT DOCUMENTS

JP 2002-326357 11/2002
JP 2003-170591 6/2003
JP 2005-231174 9/2005
JP 2010-005919 1/2010

* cited by examiner

*Primary Examiner* — Geoffrey Mruk
*Assistant Examiner* — Scott A Richmond
(74) *Attorney, Agent, or Firm* — Cooper & Dunham LLP

(57) ABSTRACT

An image forming apparatus includes: a liquid ejecting head including a nozzle that ejects a droplet and a pressure producing unit that produces pressure to pressurize a pressure chamber communicating with the nozzle; and a head drive controlling unit that provides a driving signal to the pressure producing unit. The head drive controlling unit outputs the driving signal including at least a first driving pulse and a second driving pulse to eject droplets and a residual vibration suppressing pulse to suppress residual vibration in the pressure chamber without ejecting a droplet. The residual vibration suppressing pulse is output at such a timing that the residual vibration suppressing pulse has an opposite phase to a composite vibration Vab that is formed by superposition of a meniscus vibration Va generated by droplet ejection with the first driving pulse and a meniscus vibration Vb generated by droplet ejection with the second driving pulse.

7 Claims, 17 Drawing Sheets

| | Pn+1/Pn | ATTENUATION RATE $\delta$ (=-ln(Pn+1/Pn)) |
|---|---|---|
| LOW VISCOSITY | 0.67 | 0.40 |
| REFERENCE VISCOSITY | 0.53 | 0.63 |
| HIGH VISCOSITY | 0.36 | 1.03 |

IMAGE FORMING APPARATUS AND METHOD OF DRIVING LIQUID EJECTING HEAD

CROSS-REFERENCE TO RELATED APPLICATIONS

The present application claims priority to and incorporates by reference the entire contents of Japanese Patent Application No. 2013-021835 filed in Japan on Feb. 6, 2013.

BACKGROUND OF THE INVENTION

1. Field of the Invention

The present invention relates to an image forming apparatus and a method of driving a liquid ejecting head.

2. Description of the Related Art

Inkjet recording apparatuses or similar apparatuses, which are image forming apparatuses of a liquid ejection recording system with a recording head of a liquid ejecting head (droplet ejecting head) that ejects droplets, have been known as image forming apparatuses such as printers, facsimiles, copying machines, plotters, and multifunction peripherals of these.

Japanese Patent Application Laid-open No. 2005-231174 discloses a method of controlling driving of a liquid ejecting head used in an image forming apparatus. In the method, after a driving pulse (droplet ejecting pulse) for ejecting a droplet is applied, a vibration suppressing pulse (non-ejecting pulse) with a pulse width Pws is applied (0.9 to 1.1)×((5/4)Tc−(Pws/2)) after the rising edge of the droplet ejecting pulse, where Tc denotes a natural vibration period in an individual liquid chamber (individual passage), in order to suppress the vibration due to droplet ejection.

As described above, as the timing of applying a residual vibration suppressing pulse, the time from the end of an ejecting pulse for ejecting a droplet to the midpoint of a pulse width Pw of the residual vibration suppressing pulse has been set to (5/4)Tc, thereby enabling the residual vibration to be suppressed most effectively.

However, when multi-pulse driving is performed for, for example, forming a single dot by merging a plurality of ejected droplets in flight, the residual vibration of the meniscus after the droplet ejection is formed by superposition of vibrations caused by a plurality of ejecting pulses. The phase of the residual vibration in this case is different from that of the residual vibration when a droplet is ejected with a single pulse.

In particular, the attenuation of the residual vibration of the meniscus is slow at a low viscosity, and thus the previous residual vibration remains strong at the time of the subsequent droplet ejection, resulting in a large phase difference.

This means that the conventional timing mentioned above for applying the residual vibration suppressing pulse deviates from an optimal timing due to the phase difference. The residual vibration suppressing pulse thus more greatly deviates from the optimal timing at a lower viscosity at which the attenuation speed of the residual vibration decreases and suppression is more required.

Sufficient vibration suppression effect thus cannot be obtained, causing defects such as a curved droplet and liquid overflow during the subsequent droplet ejection.

In view of the above, there is a need to enables residual vibration to be suppressed effectively even when a single dot is formed by ejecting a plurality of droplets.

SUMMARY OF THE INVENTION

It is an object of the present invention to at least partially solve the problems in the conventional technology.

An image forming apparatus includes: a liquid ejecting head including a nozzle that ejects a droplet and a pressure producing unit that produces pressure to pressurize a pressure chamber communicating with the nozzle; and a head drive controlling unit that provides a driving signal to the pressure producing unit of the liquid ejecting head to drive the liquid ejecting head. The head drive controlling unit outputs the driving signal including at least a first driving pulse and a second driving pulse to eject droplets and a residual vibration suppressing pulse to suppress residual vibration in the pressure chamber without ejecting a droplet. The residual vibration suppressing pulse is output at such a timing that the residual vibration suppressing pulse has an opposite phase to a composite vibration Vab that is formed by superposition of a meniscus vibration Va generated by droplet ejection with the first driving pulse and a meniscus vibration Vb generated by droplet ejection with the second driving pulse.

An image forming apparatus includes: a liquid ejecting head including a nozzle that ejects a droplet and a pressure producing unit that produces pressure to pressurize a pressure chamber communicating with the nozzle; and a head drive controlling unit that provides a driving signal to the pressure producing unit of the liquid ejecting head to drive the liquid ejecting head. The head drive controlling unit outputs a first driving signal including a single driving pulse for ejecting a droplet and a residual vibration suppressing pulse for suppressing a residual vibration in the pressure chamber without ejecting a droplet, and a second driving signal including at least a plurality of driving pulses for ejecting droplets and the residual vibration suppressing pulse for suppressing residual vibration in the pressure chamber without ejecting a droplet. A waveform of the single driving pulse of the first driving signal is same as a waveform of the last driving pulse of the second driving signal. When T1 denotes a time from an end of the driving pulse of the first driving signal to application of the residual vibration suppressing pulse, and T2 denotes a time from an end of the last driving pulse of the second driving signal to application of the residual vibration suppressing pulse, an absolute value of a difference between the time T1 and the time T2 increases with decrease in a viscosity of liquid to be ejected or increase in an environmental temperature of the apparatus.

A head drive controlling method provides a driving signal to a pressure producing unit of a liquid ejecting head including a nozzle that ejects a droplet and the pressure producing unit that produces pressure to pressurize a pressure chamber communicating with the nozzle to drive the liquid ejecting head, the head drive controlling method. The driving signal including at least a first driving pulse and a second driving pulse for ejecting droplets and a residual vibration suppressing pulse for suppressing residual vibration in the pressure chamber without ejecting a droplet is output. The residual vibration suppressing pulse is output to match a composite vibration Vab that is formed by superposition of a meniscus vibration Va generated by droplet ejection with the first driving pulse and a meniscus vibration Vb generated by droplet ejection with the second driving pulse.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
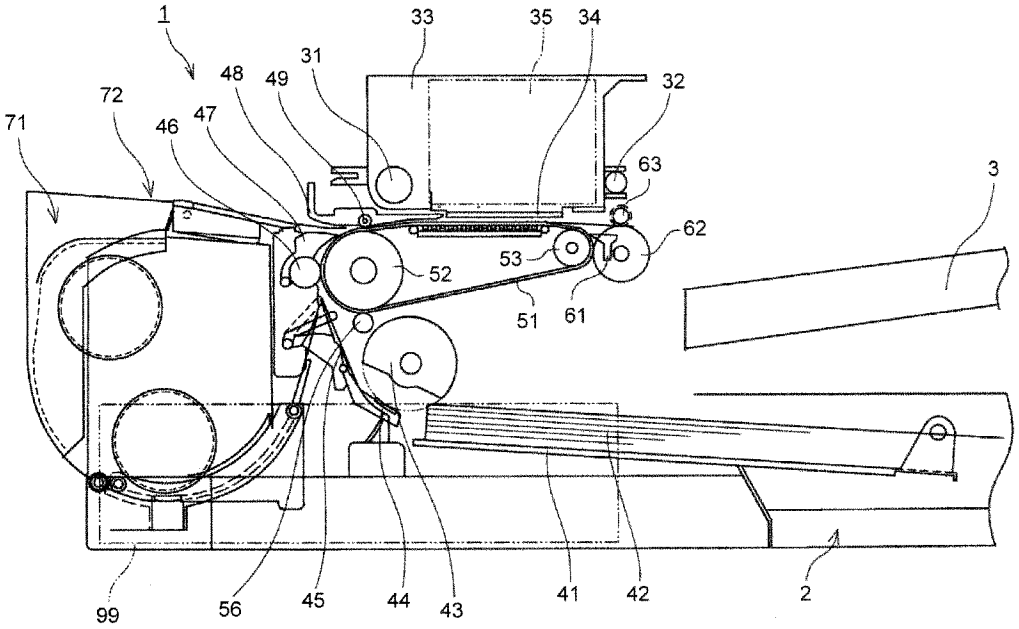
FIG. 1 is an explanatory side view illustrating a mechanical section of an example of an image forming apparatus according to the present invention.
Figure 2:
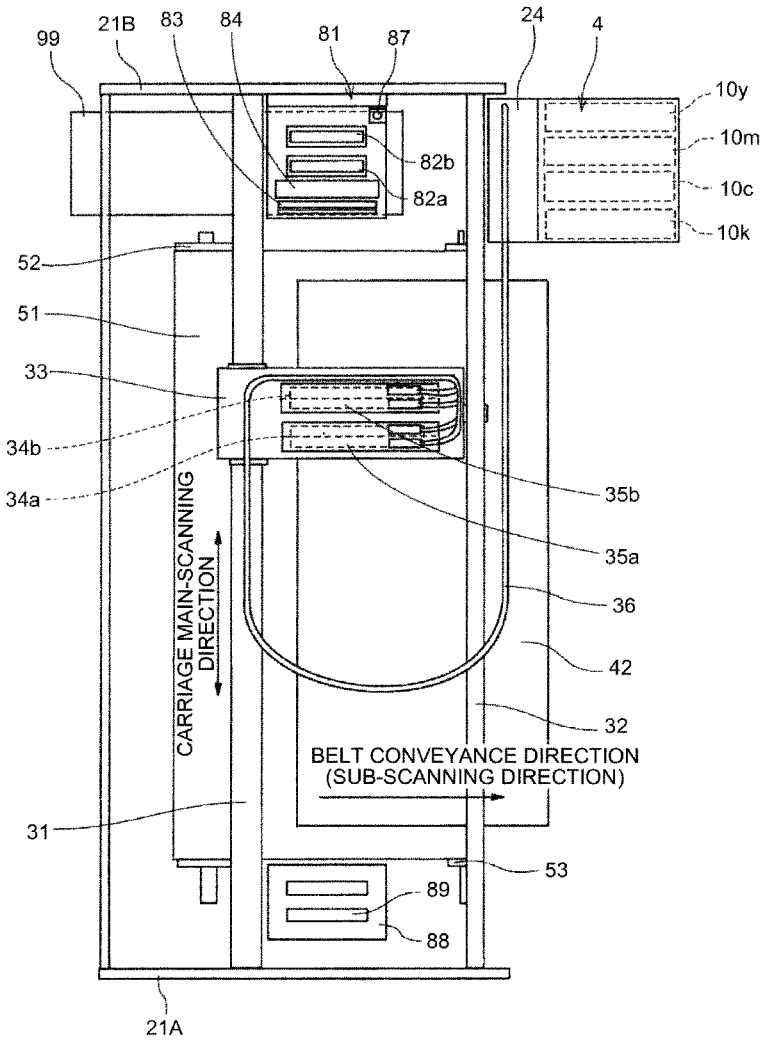
FIG. 2 is an explanatory plan view of the main part of the mechanical section.

The embodiments of the present invention are described with reference to the accompanying drawings. An example of an image forming apparatus according to the present invention is described with reference to FIGS. 1 and 2. FIG. 1 is an explanatory side view of a mechanical section of the image forming apparatus, and FIG. 2 is an explanatory plan view of the main part of the apparatus.

This image forming apparatus is a serial type inkjet recording apparatus. A main guide rod 31 and a sub guide rod 32 serving as guiding members suspended between a right side plate 21A and a left side plate 21B of an apparatus main body 1 hold a carriage 33 slidably in the main-scanning direction. The carriage 33 is linearly moved in an arrow direction (carriage main-scanning direction) in FIG. 2 for scanning by the use of a main-scanning motor (not shown) via a timing belt.

Recording heads 34*a*, 34*b* (called "recording heads 34" without distinction) composed of liquid ejecting heads are mounted on the carriage 33. The two recording heads 34 eject ink droplets in the respective colors of yellow (Y), cyan (C), magenta (M), and black (B), for example. In the recording heads 34, nozzle arrays each composed of a plurality of nozzles are arranged in the sub-scanning direction orthogonal to the main-scanning direction and the recording heads 34 eject ink droplets downward.

The recording heads 34 each include two of the nozzle arrays. One nozzle array of the recording head 34*a* ejects droplets of black (K), and the other nozzle array ejects droplets of cyan (C). One nozzle array of the recording head 34*b* ejects droplets of magenta (M), and the other nozzle array ejects droplets of yellow (Y). As the recording heads 34, recording heads including nozzle arrays for the respective colors in which a plurality of nozzles are arranged on a single nozzle surface may be used.

The carriage 33 is also equipped with head tanks 35*a*, 35*b* (called "head tanks 35" without distinction) as second ink supplying units corresponding to the nozzle arrays of the recording heads 34 for supplying inks of the respective colors. The inks are supplied to the head tanks 35 from ink cartridges (main tanks) 10 for the inks of the respective colors that are detachably loaded on a cartridge loading section 4. A supply pump unit 24 supplies the inks of the respective colors in the ink cartridges 10 to the head tanks 35 via supply tubes 36.

Sheets 42 are stacked on a sheet stacking unit (pressurizing plate) 41 of a sheet feeding trey 2. The sheets 42 are separated one by one to be fed with a semicircular roller (sheet feeding roller) 43 and a separating pad 44 that opposes the sheet feeding roller 43 and is made from a material with a large coefficient of friction. The separating pad 44 is urged to the sheet feeding roller 43.

The fed sheet 42 is sent to the space between a conveying belt 51 as a conveyer and a pressurizing roller 49 via a guiding member 45 guiding the sheet 42, a counter roller 46, and a conveyance guiding member 47. The conveying belt 51 electrostatically attracts the sheet 42 and conveys it to the position facing the recording heads 34.

The conveying belt 51 is an endless belt and is stretched between a conveying roller 52 and a tension roller 53 to turn around in the belt conveyance direction (sub-scanning direction). The image forming apparatus also includes a charging roller 56 as a charging unit for charging the surface of the conveying belt 51. The charging roller 56 is disposed in contact with the surface of the conveying belt 51 to be driven to rotate in accordance with the rotation of the conveying belt 51.

The conveying roller 52 is driven to rotate by a sub-scanning motor (not shown) with a timing, thereby causing the conveying belt 51 to rotationally move in the belt conveyance direction in FIG. 2.

The image forming apparatus Further, as a sheet discharging unit for discharging the sheet 42 on which recording is performed by the recording heads 34, a separation claw 61 to separate the sheet 42 from the conveying belt 51, a sheet discharge roller 62, and a spur 63 being a discharging rolling member are provided, and a sheet discharge tray 3 is provided below the sheet discharge roller 62.

A double-sided unit 71 is detachably mounted on the back of the apparatus main body 1. The double-sided unit 71 takes in the sheet 42 returned in accordance with the rotation of the conveying belt 51 in the reverse direction and feeds the sheet 42 in the space between the counter roller 46 and the conveying belt 51 again while reversing the sheet 42. The top face of the double-sided unit 71 serves as a manual feeding tray 72.

A maintenance and recovery mechanism 81 that maintains and recovers the state of the nozzles of the recording heads 34 is disposed in a non-printing area at one side in the main-scanning direction of the carriage 33.

The maintenance and recovery mechanism 81 includes cap members (called "caps", hereinafter) 82*a*, 82*b* ("caps 82" without distinction) for capping the respective nozzle surfaces of the recording heads 34.

The maintenance and recovery mechanism 81 also includes a wiping member (wiper blade) 83 for wiping the nozzle surfaces. The maintenance and recovery mechanism 81 further includes an idle ejection receiver 84 that receives a droplet produced in idle ejection for ejecting the droplet not contributing to recording in order to discharge a recording liquid with an increased viscosity, and a carriage lock 87 that locks the carriage 33.

A waste liquid tank 99 that contains waste liquid produced through the maintenance and recovery actions is replaceably mounted on the apparatus main body, below the maintenance and recovery mechanism 81.

An idle ejection receiver 88 that receives, during recording or other operations, a droplet produced in idle ejection for ejecting the droplet not contributing to recording in order to discharge a recording liquid with an increased viscosity is disposed in a non-printing area at the other side in the main-scanning direction of the carriage 33. The idle ejection receiver 88 includes openings 89 formed along the nozzle array directions of the recording heads 34.

In the image forming apparatus with such a configuration, the sheets 42 are separated and fed from the sheet feeding tray 2 one by one. The sheet 42 fed in the substantially vertical upward direction is guided by the guiding member 45 and is nipped between the conveying belt 51 and the counter roller 46 for conveyance. The leading end of the sheet 42 is then guided by the conveyance guiding member 47 and is pressed against the conveying belt 51 with the leading end pressurizing roller 49, and thus its conveyance direction is changed by about 90°.

In this operation, voltage is applied to the charging roller 56 so that positive output and negative output are repeated alternately, thereby charging the conveying belt 51 in alternating charging voltage patterns. When the sheet 42 is fed onto the charged conveying belt 51, the sheet 42 is attracted to adhere to the conveying belt 51 and is conveyed in the sub-scanning direction in accordance with the rotational movement of the conveying belt 51.

While the carriage 33 is moved, the recording heads 34 are driven in response to an image signal to eject ink droplets onto the sheet 42 at a stop for one-line recording. The sheet 42 is conveyed by a certain amount and then recording of the subsequent line is performed. The recording action ends in response to a recording end signal or a signal indicating that the trailing end of the sheet 42 has reached the recording area, and the sheet 42 is discharged to the sheet discharge tray 3.

For the maintenance and recovery of the nozzles of the recording heads 34, the carriage 33 is moved to a home position facing the maintenance and recovery mechanism 81. Maintenance and recovery actions are performed such as nozzle suction of sucking from the nozzles capped with the cap members 82 and an idle ejection action of ejecting droplets not contributing to image formation. An image can be thus formed by stable droplet ejection.

Figure 3:
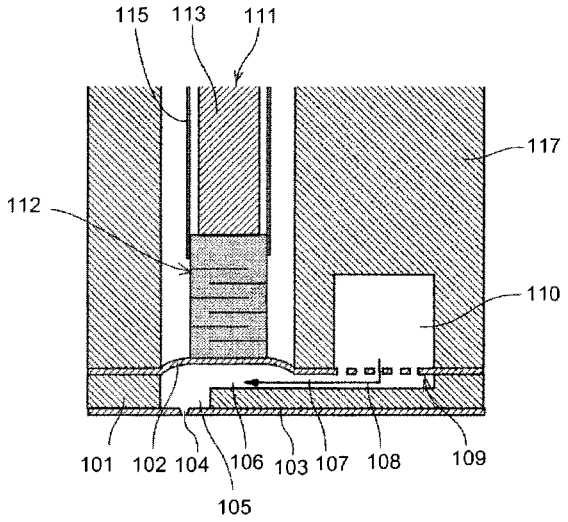
FIG. 3 is an explanatory sectional view of an example of a liquid ejecting head as a recording head of the image forming apparatus in the longitudinal direction of a liquid chamber.
Figure 4:
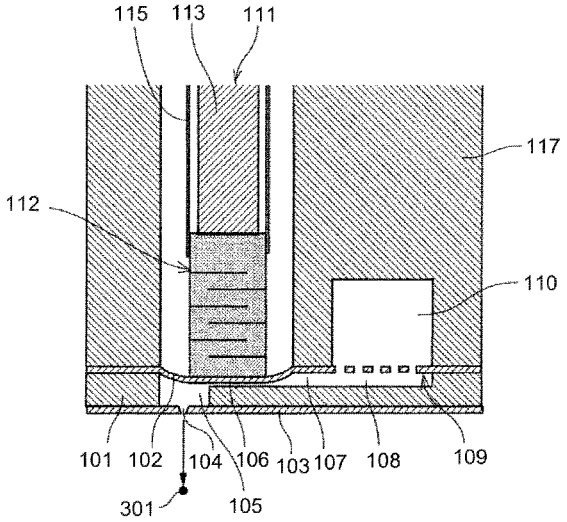
FIG. 4 is an explanatory sectional view of the example for explaining a droplet ejecting action.

An example of one of the liquid ejecting heads as the recording heads 34 is described with reference to FIGS. 3 and 4. FIGS. 3 and 4 are explanatory sectional views of the head along the longitudinal direction (direction orthogonal to the nozzle array direction) of a liquid chamber.

In the liquid ejecting head, a channel plate 101 is joined with a vibrating plate member 102 and a nozzle plate 103. These plates forms a pressure chamber 106 that is an individual liquid chamber communicating with a nozzle 104 ejecting droplets through a through hole 105, a fluid resistance portion 107 through which liquid is supplied to the pressure chamber 106, and a liquid introducing portion 108. Liquid (ink) is introduced to the liquid introducing portion 108 from a common liquid chamber 110 formed in a frame member 117 through a filter portion 109 formed in the vibrating plate member 102. The ink is then supplied from the liquid introducing portion 108 to the pressure chamber 106 through the fluid resistance portion 107.

The channel plate 101 is formed by stacking metal plates of stainless steel (i.e., steel use stainless (SUS)) or other metals and forms openings and grooves such as the through hole 105, the pressure chamber 106, the fluid resistance portion 107, and the liquid introducing portion 108. The vibrating plate member 102 serves as a wall surface member that forms the wall surfaces of the pressure chamber 106, the fluid resistance portion 107, and the liquid introducing portion 108 as well as the filter portion 109. The channel plate 101 is not limited to the metal plates of SUS or other metals and may also be formed by anisotropically etching a silicon substrate.

A columnar multilayer piezoelectric member 112 as a pressure producing unit that produces pressure to pressurize the pressure chamber 106 is joined to the vibrating plate member 102 at a side opposite to the pressure chamber 106. One end of the piezoelectric member 112 is joined to a base member 113, and the piezoelectric member 112 is connected to a flexible printed circuit (FPC) 115 that transmits drive waveforms. These members constitute a piezoelectric actuator 111 as a pressure producing unit that produces pressure to pressurize the ink in the pressure chamber 106 to eject droplets from the nozzle 104.

Although the piezoelectric member 112 is used in the d33 mode in which the piezoelectric member 112 expands and contracts in the stacking direction in this example, the d31 mode in which the piezoelectric member 112 expands and contracts in a direction orthogonal to the stacking direction may also be employed.

In the liquid ejecting head with such a configuration, as illustrated in FIG. 3, for example, voltage to be applied to the piezoelectric member 112 is reduced from a reference potential Ve. This reduction causes the piezoelectric member 112 to contract to deform the vibrating plate member 102. The capacity of the pressure chamber 106 thus increases to cause the ink to flow into the pressure chamber 106. Subsequently, as illustrated in FIG. 4, the voltage to be applied to the piezoelectric member 112 is increased. This increase causes the piezoelectric member 112 to expand in the stacking direction to deform the vibrating plate member 102 in the direction toward the nozzle 104. The capacity of the pressure chamber 106 thus reduces to pressurize the ink in the pressure chamber 106, thereby ejecting a droplet 301 from the nozzle 104.

The vibrating plate member 102 is restored to the initial position by returning the voltage applied to the piezoelectric member 112 to the reference potential Ve. In this operation, the pressure chamber 106 expands to produce negative pressure and is filled with the ink from the common liquid chamber 110. After the vibration of the meniscus surface at the nozzle 104 attenuates to be stable, the operation moves on to the subsequent droplet ejection.

Figure 5:
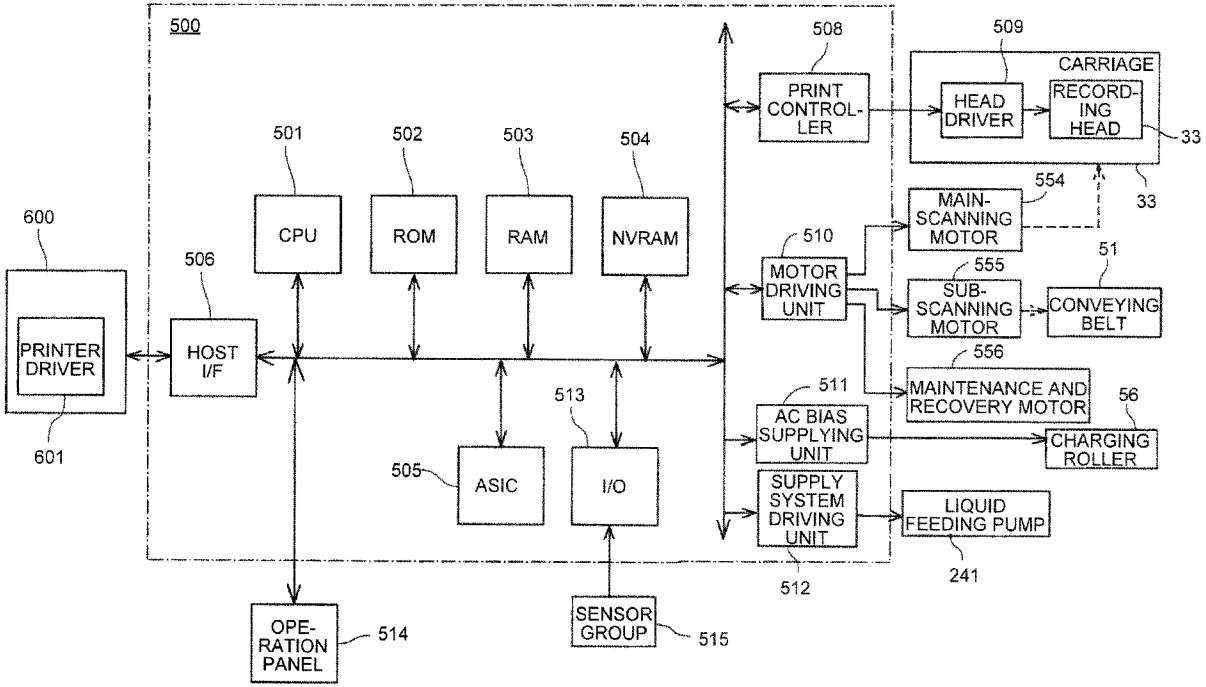
FIG. 5 is a schematic explanatory block diagram of a controller of the image forming apparatus.

A controller of this image forming apparatus is schematically described with reference to FIG. 5. FIG. 5 is an explanatory block diagram of the controller.

This controller 500 includes a central processing unit (CPU) 501 that is responsible for controlling the whole apparatus, a read only memory (ROM) 502 that stores therein fixed data such as various computer programs including a computer program executed by the CPU 501, and a random access memory (RAM) 503 that temporarily stores therein image data or other data. The controller 500 also includes a rewritable nonvolatile memory 504 that holds therein data even when the power of the apparatus is off. The controller 500 further includes an application-specific integrated circuit (ASIC) 505 that performs image processing such as various types of signal processing and sorting on image data and processes input and output signals for controlling the whole apparatus.

The controller 500 includes a print controller 508 including a data transferring unit and a driving signal generating unit for controlling driving of the recording heads 34, and a head driver (driver integrated circuit (IC)) 509 for driving the recording heads 34 mounted on the carriage 33. The controller 500 includes a main-scanning motor 554 that linearly moves the carriage 33 and a sub-scanning motor 555 that rotationally moves the conveying belt 51. The controller 500 also includes a motor driving unit 510 that drives a maintenance and recovery motor 556 for, for example, moving the caps 82 and the wiping member 83 of the maintenance and recovery mechanism 81 and operating a suction pump 812. The controller 500 further includes an alternating-current (AC) bias supplying unit 511 that supplies AC bias to the charging roller 56 and a supply system driving unit 512 that drives a liquid feeding pump 241.

The controller 500 is connected to an operation panel 514 for inputting and displaying information required for this apparatus.

The controller 500 includes an interface (I/F) 506 through which data and signals are transmitted to or received from a host. The controller 500 receives data and signals from a host 900 including an information processor such as a personal computer and an image reading apparatus such as an image scanner via the I/F 506 through a cable or a network.

The CPU 501 of the controller 500 reads print data in the receiving buffer of the I/F 506 to analyze it, performs necessary processing such as image processing and data sorting in the ASIC 505, and transfers the image data from the print controller 508 to the head driver 509. A printer driver 901 in the host 900 or the controller 500 may generate dot pattern data for outputting an image.

The print controller 508 transfers the image data mentioned above to the head driver 509 as serial data. The print controller 508 outputs to the head driver 509, a transfer clock, a latch signal, or other signals required for, for example, transferring image data or settling the transfer.

The head driver 509 applies a needed driving voltage to the piezoelectric member 112 of each of the nozzles 104 by opening and closing a feed line to the piezoelectric member 112 with a switching element according to image data serially input from the print controller 508. This head driver 509 includes a shift register that captures image data for one line, a latch circuit that latches data captured in the shift register, and a switching element that is on/off-controlled by the output from the latch circuit.

Here, the print controller 508 and the head driver 509 constitute a head drive controlling unit.

An input/output (I/O) unit 513 acquires information from a sensor group 515 consisting of various sensors mounted on the apparatus, extracts information required for controlling the printer, and uses the information in control of the print controller 508, the motor driving unit 510, and the AC bias supplying unit 511. The sensor group 515 includes an optical sensor for detecting the position of a sheet, a thermistor for monitoring the temperature in the apparatus, and a sensor for monitoring the voltage of the charged belt. The I/O unit 513 can deal with various types of sensor information.

Figure 6:
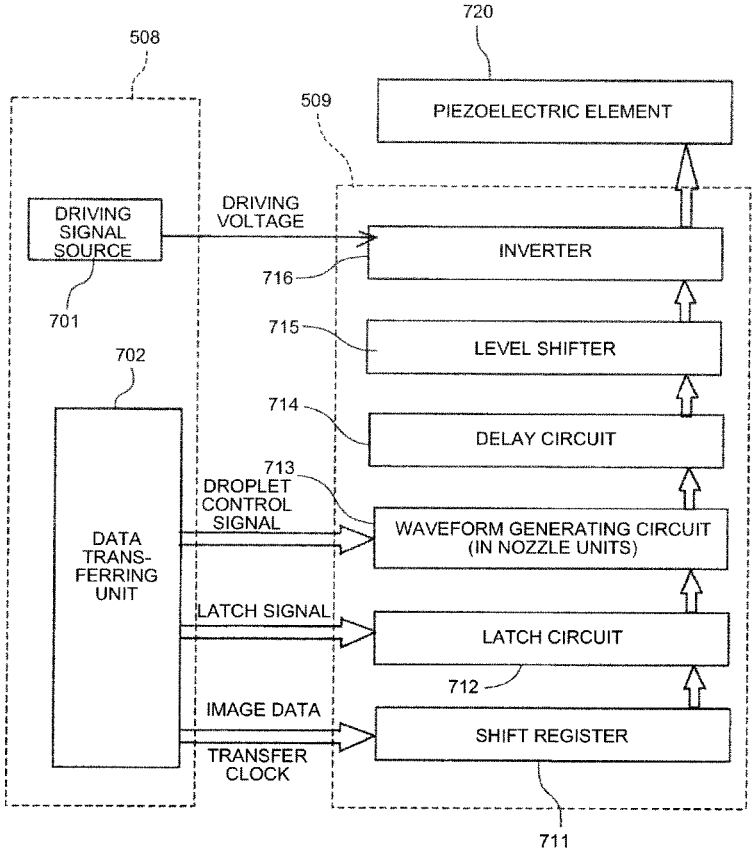
FIG. 6 is an explanatory block diagram of an example of the print controller and the head driver.

An example of the print controller and the head driver is described with reference to the explanatory block diagram of FIG. 6.

The print controller 508 includes a driving signal source 701 and a data transferring unit 702. The driving signal source 701 outputs a given driving voltage. The data transferring unit 702 outputs image data (gradation signals 0, 1) of two bits, a transfer clock signal, a latch signal, and a droplet control signal according to a print image.

The head driver 509 includes a shift register 711 to which a transfer clock (shift clock) and serial image data (gradation data: two bits/one channel (one nozzle)) are input from the data transferring unit 702. The head driver 509 includes a latch circuit (register) 712 that latches each resister value of the shift register 711 in responses to a latch signal.

The head driver 509 includes a waveform generating circuit 713 that generates a driving pulse in nozzle units using the gradation data and droplet control signals M0 to M3. The head driver 509 also includes a delay circuit 714 that delays the driving pulse output from the waveform generating circuit 713 and a level shifter 715 that converts a logic level voltage signal to a level in which an inverter 716 is operable.

The head driver 509 further includes the inverter 716 that operates with a driving pulse for each nozzle provided from the waveform generating circuit 713 through the delay circuit 714 and the level shifter 715.

The driving voltage from the driving signal source 701 is input to the inverter 716. The inverter 716 operates with the driving pulse from the waveform generating circuit 713 to change the driving voltage supplied to a piezoelectric element 720 (piezoelectric member 112) into a pulse voltage.

Figure 7:
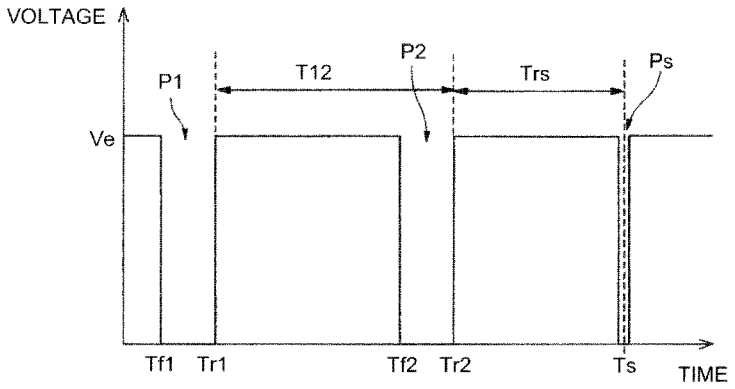
FIG. 7 is a graph for explaining a driving signal according to a first embodiment of the present invention.
Figure 8:
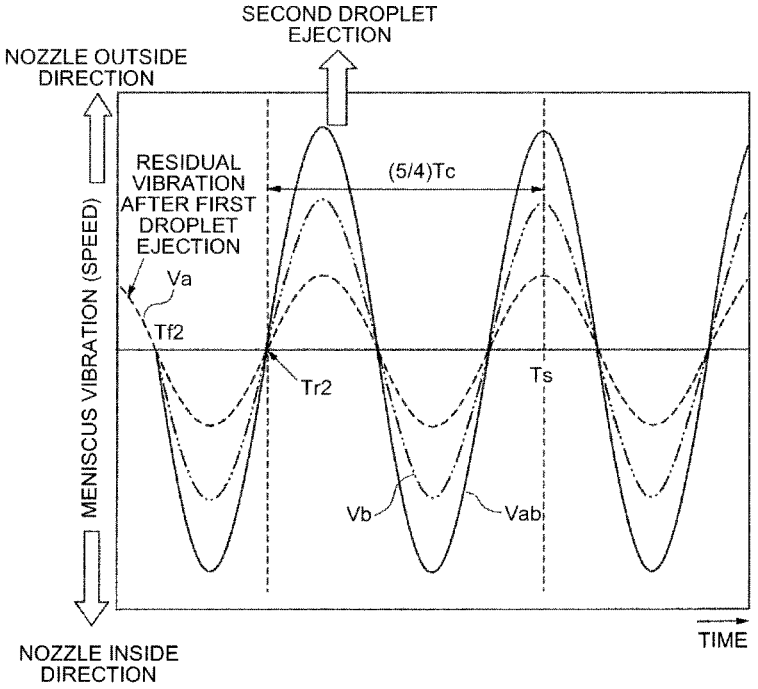
FIG. 8 is a graph illustrating meniscus vibrations approximately with sine waves for explaining the output timing of a residual vibration suppressing pulse Ps in the first embodiment.

The following describes a first embodiment of the present invention with reference to FIG. 7. FIG. 7 is a graph for explaining a driving signal according to the present embodiment.

The driving signal in the present embodiment includes a first driving pulse (first ejecting pulse) P1 for ejecting a droplet, a second driving pulse (second ejecting pulse) P2 for ejecting a droplet, and a residual vibration suppressing pulse Ps for suppressing residual vibration in a pressure chamber without droplet ejection.

In the present embodiment, a constant voltage is applied to the piezoelectric member 112 and a driving pulse is applied by ON/OFF of the switching element. The pulse voltages of individual driving pulses (ejecting pulses) are all fixed.

The control of the drop speed and drop amount of ink droplets is adjusted through the pulse width of each of the first driving pulses P1, P2 and a pulse interval T12. The pulse widths of the first driving pulses P1, P2 are fixed to a given value for simplification.

In the present embodiment, the first driving pulse P1 falls at a time point Tf1 and rises at a time point Tr1 after a time of a certain pulse width has passed. The first droplet is ejected in the following manner. The piezoelectric member 112 contracts due to the fall of the first driving pulse P1 at the falling time point Tf1 to cause the pressure chamber 106 to expand, and then expands due to the rise of the first driving pulse P1 at the rising time point Tr1 to cause the pressure chamber 106 to contract, whereby the first droplet is ejected.

The second driving pulse P2 falls at a time point Tf2 after a certain pulse interval has passed from the rising time point Tr1 of the first driving pulse P1, and rises at a time point Tr2 after a time of a certain pulse width has passed. The second droplet is ejected in the following manner. The piezoelectric member 112 contracts due to the fall of the second driving pulse P2 at the falling time point Tf2 to cause the pressure chamber 106 to expand, and then expands due to the rise of the second driving pulse P2 at the rising time point Tr2 to cause the pressure chamber 106 to contract, whereby the second droplet is ejected.

In this operation, the time from the rising time point Tr1 of the first driving pulse P1 to the rising time point Tr2 of the second driving pulse P2 is designated as a time T12.

The middle time point between the starting time point (falling time point) and the ending time point (rising time point) of the residual vibration suppressing pulse Ps is designated as a time point Ts. The time from the rising time point Tr2 (second droplet ejecting timing) of the second driving pulse P2 to the time point Ts is designated as a time Trs.

The residual vibration suppressing pulse Ps causes the pressure chamber 106 to expand when the meniscus vibration caused by droplet ejection increases toward outside the nozzle. This brings the meniscus toward inside the nozzle, thereby suppressing the residual vibration of the meniscus vibration caused by the droplet ejection.

The following describes the output timing of the residual vibration suppressing pulse Ps in the present embodiment with reference to FIG. 7. FIG. 7 is a graph illustrating meniscus vibrations approximately with sine waves for explaining the output timing.

A droplet is ejected with the first driving pulse P1, whereby a meniscus vibration Va is generated as illustrated in FIG. 7 with a broken line. The residual vibration of the meniscus vibration Va remains at the time of ejection of the second droplet with the second driving pulse P2.

As illustrated in FIG. 7 with a chain double-dashed line, the meniscus is then drawn toward inside the nozzle in response to the fall of the second driving pulse P2 at the time point Tf2 and is pushed toward outside the nozzle in response to the rise of the second driving pulse P2 at the time point Tr2. The second droplet is ejected when the meniscus is pushed most outside the nozzle.

A meniscus vibration Vb is generated by droplet ejection with the second driving pulse P2.

The residual vibrations of the meniscus vibrations Va, Vb are generated in the same period as a natural vibration period Tc of the pressure chamber 106. Although the residual vibrations mean the parts of the meniscus vibrations after droplet ejection, the residual vibrations are also denoted by the meniscus vibrations Va, Vb to simplify the description.

In the example of FIG. 7, the phase of the meniscus vibration Va excited by the droplet ejection with the first driving pulse P1 corresponds to that of the meniscus vibration Vb excited by the droplet ejection with the second driving pulse P2. This indicates that the second droplet is ejected by utilizing the residual vibration of the meniscus vibration Va after the first droplet ejection.

A composite vibration Vab that is a superposed vibration in which the meniscus vibration Va and the meniscus vibration Vb are superposed corresponds with the meniscus vibrations Va, Vb in phase and timing. This means that the vibration period of the composite vibration Vab is also the same as the natural vibration period Tc of the pressure chamber 106.

Consequently, the composite vibration Vab of the residual vibrations becomes the largest toward outside the nozzle at the time when (5/4) Tc has passed from the rising time point Tr2 of the second driving pulse P2.

The residual vibration suppressing pulse Ps is then applied at a timing when the elapsed time Trs from the rising time point Tr2 of the second driving pulse P2 satisfies Trs=(5/4)Tc. In other words, the timing (output timing) of applying the residual vibration suppressing pulse Pa is set such that the elapsed time Trs from the rising time point Tr2 of the second driving pulse P2 to the middle time point Ts of the vibration suppressing pulse Ps is (5/4)Tc.

The residual vibration suppressing pulse Ps causes the pressure chamber 106 to expand when the composite vibration Vab caused by droplet ejection increases toward outside the nozzle. This brings the meniscus toward inside the nozzle to suppress the residual vibration of the meniscus vibration caused by the droplet ejection.

In such a manner, a driving signal is output including at least a first driving pulse and a second driving pulse for ejecting droplets and a residual vibration suppressing pulse for suppressing the residual vibration in the individual liquid chamber without droplet ejection. The residual vibration suppressing pulse is output at such a timing that the residual vibration suppressing pulse has an opposite phase to the composite vibration Vab that is formed by superposition of the meniscus vibration Va generated by the droplet ejection with the first driving pulse and the meniscus vibration Vb generated by the droplet ejection with the second driving pulse. This can suppress the residual vibration reliably even when droplets are ejected with a plurality of successive driving pulses and can prevent defects from occurring such as curving and meniscus outflow in the subsequent droplet.

Figure 9A:
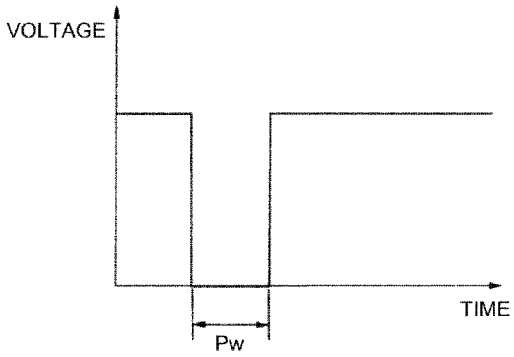
FIGS. 9A and 9B are graphs for explaining the pulse width of the residual vibration suppressing pulse Ps.
Figure 9B:
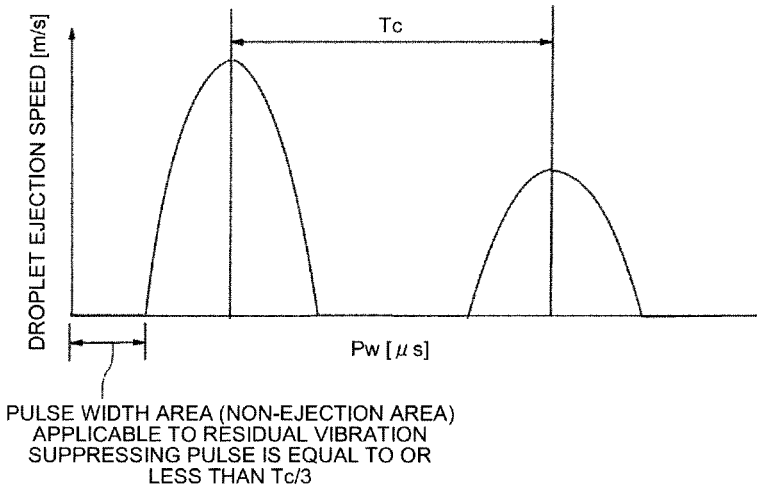

The following describes a pulse width Pw of the residual vibration suppressing pulse Ps with reference to FIGS. 9A and 9B.

The residual vibration suppressing pulse Ps is a pulse for providing fine vibration to the extent that no droplet is ejected. Its waveform is, however, formed by switching in the present embodiment, and thus, the voltage value (driving voltage) cannot be changed. A pulse having a pulse width Pw shortened to the extent that no droplet is ejected is thus employed as the residual vibration suppressing pulse Ps.

Specifically, FIG. 9B indicates a droplet ejection speed when the pulse width Pw of the pulse in FIG. 9A is changed. Little driving can be performed without droplet ejection by employing the width of the first non-ejection area in FIG. 9B as the pulse width Pw of the residual vibration suppressing pulse Ps.

The non-ejection area is within the range of ⅓ of the natural vibration period Tc of the pressure chamber 106 regardless of the viscosity of liquid (ink) to be ejected, the structure of the head, or the like.

Therefore, it is preferable that the pulse width Pw of the residual vibration suppressing pulse Ps be equal to or smaller than ⅓ of the natural vibration period Tc of the pressure chamber 106 in order to perform little driving reliably without droplet ejection.

Figure 10:
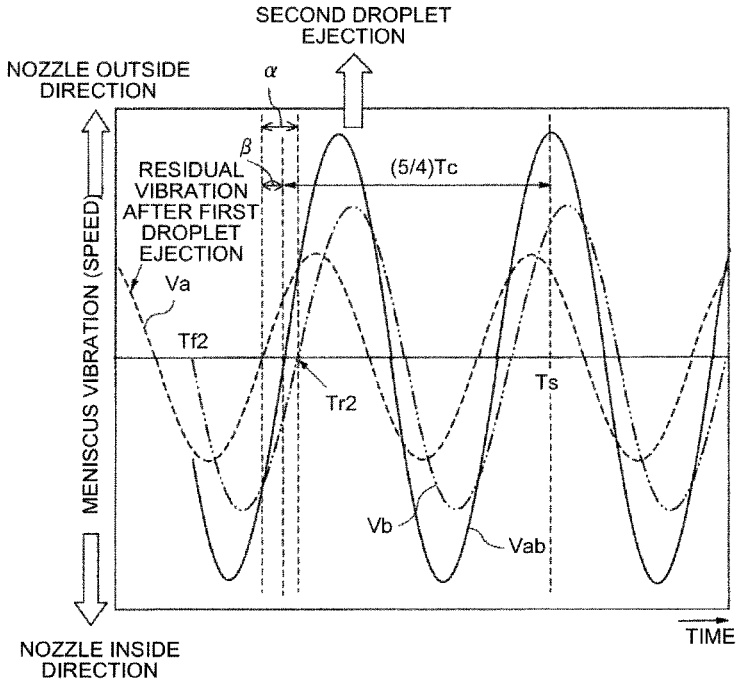
FIG. 10 is a graph illustrating meniscus vibrations approximately with sine waves for explaining the output timing of the residual vibration suppressing pulse Ps according to a second embodiment of the present invention.

The following describes a second embodiment of the present invention with reference to FIG. 10. FIG. 10 is a graph illustrating meniscus vibrations approximately with sine waves for explaining the output timing of the residual vibration suppressing pulse Ps in the present embodiment.

In the present embodiment, the phase of the meniscus vibration Vb generated by the droplet ejection with the second driving pulse P2 is behind that of the meniscus vibration Va generated by the droplet ejection with the first driving pulse P1 by a time $\alpha 1$ ($0<\alpha 1\leq Tc/2$). That is, this is an example for ejecting the second droplet at a timing delayed with respect to the residual vibration after the first droplet ejection by the time $\alpha 1$.

The phase of the composite vibration Vab formed by superposition of the meniscus vibration Va and the meniscus vibration Vb is thus behind that of the meniscus vibration Va by a time $\beta$.

In this case, if the timing Ts of the residual vibration suppressing pulse Ps is at the time when (5/4)Tc has passed from the rising time point Tr2 of the second driving pulse P2, the residual vibration suppressing pulse Ps cannot be applied at a timing when the composite vibration Vab reaches the maximum.

The timing Ts of the residual vibration suppressing pulse Ps is thus adjusted to a timing when $(5/4)Tc-(\alpha 1-\beta 1)$ has passed from the rising time point Tr2 of the second driving pulse P2. In other words, the residual vibrations can be suppressed most effectively by applying the residual vibration suppressing pulse Ps at a timing when the time Trs from the rising time point Tr2 of the second driving pulse P2 is $(5/4)Tc+\beta 1-\alpha 1$.

As described above, in the droplet ejection with the successive driving pulses, the interval from the rising time point Tr2 of the last driving pulse to the residual vibration suppressing pulse needs to be shortened. More precisely, the interval needs to be shortened by a difference between a phase delay $\beta$ ($0<\beta\leq Tc/2$) of the composite vibration Vab and a phase delay $\alpha$ ($0<\alpha\leq Tc/2$) of the residual vibration Vb excited with the last driving pulse, with respect to the residual vibration Va of the second to last driving pulse.

This can suppress the residual vibration after droplet ejection at the optimal timing and can prevent defects from occurring such as curving and meniscus overflow in the subsequent droplet.

Figure 11:
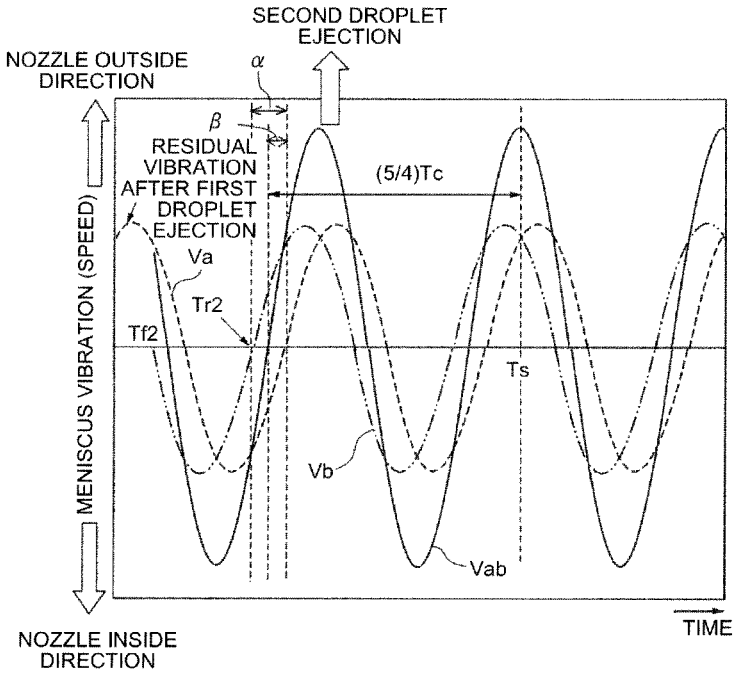
FIG. 11 is a graph illustrating meniscus vibrations approximately with sine waves for explaining the output timing of the residual vibration suppressing pulse Ps according to a third embodiment of the present invention.

The following describes a third embodiment of the present invention with reference to FIG. 11. FIG. 11 is a graph illustrating meniscus vibrations approximately with sine waves for explaining the output timing of the residual vibration suppressing pulse Ps in the present embodiment.

In the present embodiment, the phase of the meniscus vibration Vb generated by the droplet ejection with the second driving pulse P2 is ahead of that of the meniscus vibration Va generated by the droplet ejection with the first driving pulse P1 by a time $\alpha 2$ ($0<\alpha 2\leq Tc/2$). That is, this is an example for ejecting the second droplet at a timing advanced with respect to the residual vibration after the first droplet ejection by the time $\alpha 1$.

The phase of the composite vibration Vab formed by superposition of the meniscus vibration Va and the meniscus vibration Vb is thus ahead of that of the meniscus vibration Va by a time $\beta 2$ ($0<\beta 2\leq Tc/2$).

In this case, if the timing Ts of the residual vibration suppressing pulse Ps is at the time when (5/4)Tc has passed from the rising time point Tr2 of the second driving pulse P2, the residual vibration suppressing pulse Ps cannot be applied at a timing when the composite vibration Vab reaches the maximum.

The timing Ts of the residual vibration suppressing pulse Ps is thus adjusted to a timing when $(5/4)Tc+(\alpha 2-\beta 2)$ has passed from the rising time point Tr2 of the second driving pulse P2. In other words, the residual vibrations can be suppressed most effectively by applying the residual vibration suppressing pulse Ps at a timing when the time Trs from the rising time point Tr2 of the second driving pulse P2 satisfies $(5/4)Tc+\alpha 2-\beta 2$.

Figure 12:
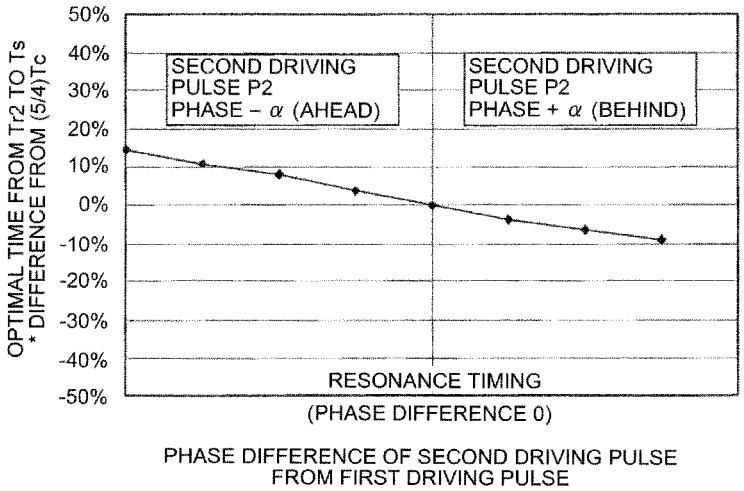
FIG. 12 is a graph for explaining the relation determined by simulation, between the phase difference of a second driving pulse P2 and an optimal timing (Tr2−Ts) for suppressing residual vibration.

FIG. 12 illustrates a relation determined by simulation under given conditions, between the phase difference of the second driving pulse P2 and an optimal timing (Tr2−Ts) for suppressing the residual vibration.

Figures 13, 14:
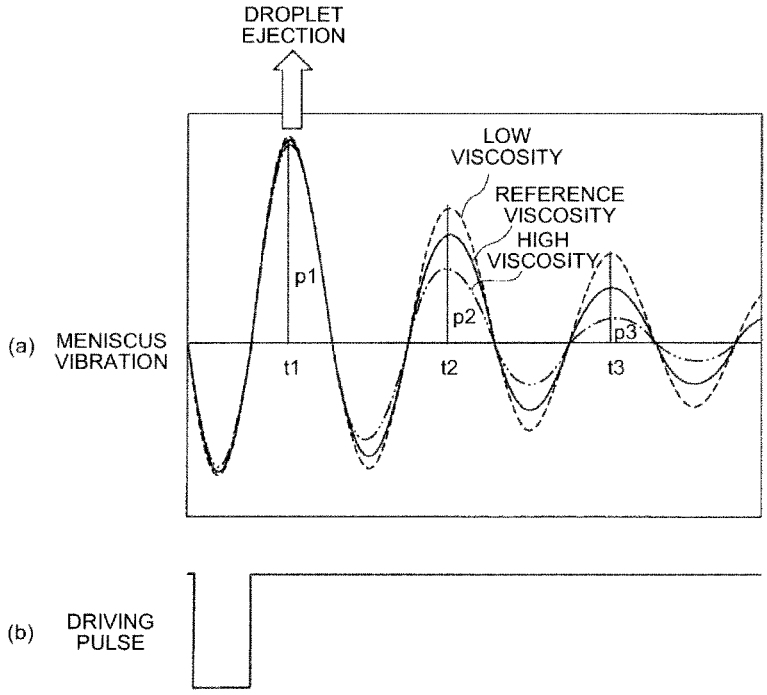
FIG. 13 is a graph of an example of the relation between an ink viscosity and the attenuation of meniscus vibration for explaining a fourth embodiment of the present invention.
FIG. 14 is a table for explaining the ink viscosity and the attenuation rate of the meniscus vibration.
Figure 15:
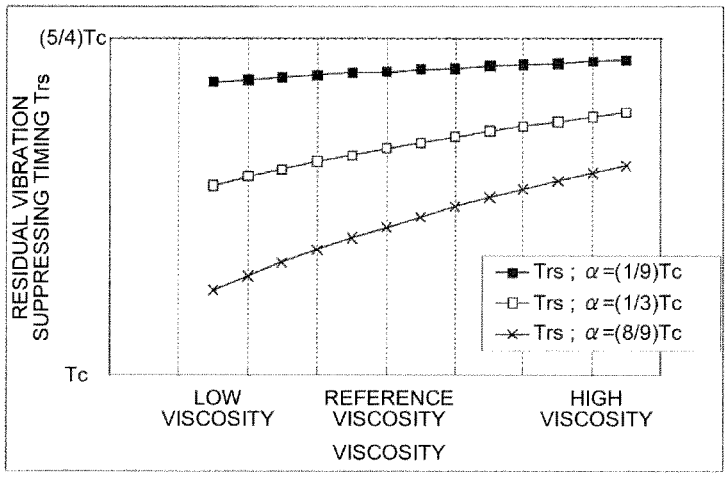
FIG. 15 is an explanatory graph of the relation between the ink viscosity and the output timing of a residual vibration suppressing pulse in the fourth embodiment.

If the phase of the second driving pulse P2 is behind that of the first driving pulse P1 (corresponding to FIG. 10), the optimal timing (an optimal time T2 from the time point Tr2 to the time point Ts) is shorter than (5/4)Tc. If the phase of the second driving pulse P2 is ahead of that of the first driving pulse P1 (corresponding to FIG. 11), the optimal timing (the optimal time T2 from the time point Tr2 to the time point Ts) is longer than (5/4)Tc. This can be also seen from the result of the simulation The following describes a fourth embodiment of the present invention with reference to FIGS. 13 to 15. FIG. 13 is a graph for explaining the relation between ink viscosities and the attenuation of meniscus vibration. FIG. 14 is a table for explaining the ink viscosity and the attenuation rate of the meniscus vibration. FIG. 15 is a graph for explaining the relation between the ink viscosity and the output timing of the residual vibration suppressing pulse in the present embodiment.

The attenuation time of the meniscus vibration generated by the droplet ejection with the first driving pulses P1, P2 mentioned above varies depending on the ink viscosity. As indicated in FIG. 13(*b*), the viscosities of inks ejected by applying a driving pulse are designated as a "reference viscosity", a "low viscosity" lower than the reference viscosity, and a "high viscosity" higher than the reference viscosity, for example.

The attenuation rate $\delta$ of the residual vibration of meniscus vibration generated by droplet ejection with the driving pulse varies depending on the viscosity of the ink. As illustrated in FIG. 13(*a*), the attenuation speed increases with increase in the viscosity and decreases with decrease in the viscosity.

FIG. 14 indicates the attenuation rates $\delta$ determined by $p(n+1)/pn=\exp(-\delta)$ using any peak pn (p1, p2, p3 . . . ) in FIG. 13(*a*) and the subsequent peak p(n+1). The attenuation rate $\delta$ may be determined through experiment or by utilizing a simulation.

The case is considered in which the phase difference between the meniscus vibration Va and the meniscus vibration Vb is $\alpha$ and the phase difference between the meniscus vibration Vb and the composite vibration Vab is $\beta$ in the meniscus vibrations Va, Vb and the composite vibration Vab described in the second embodiment (FIG. 10).

At a high ink viscosity, the attenuation of the meniscus vibration Va progresses (the peak value of the residual vibration decreases) by the time when the second driving pulse P2 is applied, and the phase of the composite vibration Vab comes closer to the phase of the meniscus vibration Vb. In other words, the value of the phase difference $\beta$ increases.

In contrast, at a low ink viscosity, the attenuation speed of the meniscus vibration Va decreases (the peak value of the residual vibration increases), and the phase of the composite vibration Vab comes closer to the phase of the meniscus vibration Va. In other words, the value of the phase difference $\beta$ decreases.

The timing (time Trs)$=(5/4)Tc-(\alpha-\beta)$ for applying the residual vibration suppressing pulse Ps is changed depending on the ink viscosity as illustrated in FIG. 15, for example. FIG. 15 is an example of the residual vibration suppressing timing Trs when $\alpha=(1/9)Tc$, $\alpha=(1/3)Tc$, and $\alpha=(8/9)Tc$. As can be seen from FIG. 15, Trs approaches (5/4)Tc with increase in the ink viscosity and departs from (5/4)Tc with decrease in the ink viscosity.

The timing of applying the residual vibration suppressing pulse is thus changed depending on the viscosity of liquid to be ejected. This enables the residual vibration after droplet ejection to be reliably suppressed even when the ink viscosity is changed. Accordingly, defects such as ejection curving and ink leakage from the nozzle during the subsequent droplet ejection can be prevented from occurring.

Figure 16:
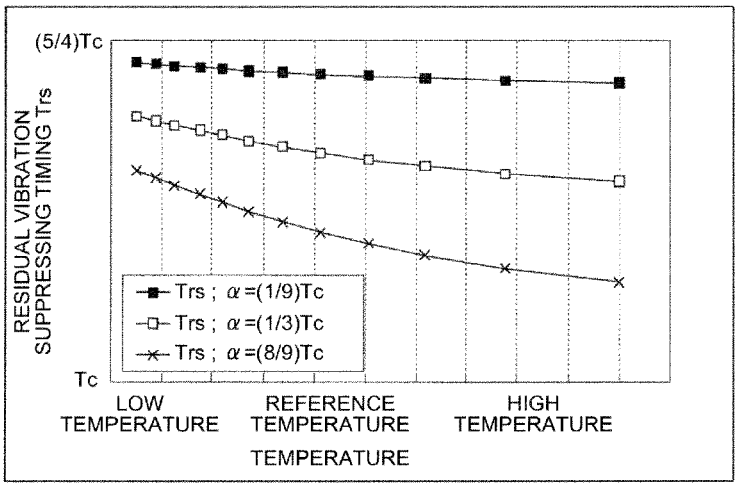
FIG. 16 is an explanatory graph of the relation between the environmental temperature and the output timing of a residual vibration suppressing pulse according to a fifth embodiment of the present invention.

The following describes a fifth embodiment of the present invention with reference to FIG. 16. FIG. 16 is an explanatory graph of the relation between the environmental temperature and the output timing of the residual vibration suppressing pulse in the present embodiment.

The viscosity of ink to be ejected mentioned above changes with the ambient temperature of the apparatus, is low in a high temperature environment, and high in a low temperature environment.

As illustrated in FIG. 16, the timing (the time Trs from the time point Tr2 to the time point Ts) for applying the residual vibration suppressing pulse Ps is thus changed so that $Trs=(5/4)Tc-(\alpha-\beta)$ is satisfied depending on the environmental temperature instead of the ink viscosity in the fourth embodiment.

At this time, the time Trs is set to be apart from (5/4)Tc at a high temperature and approach (5/4)Tc at a low temperature, for example. This enables the residual vibration to be suppressed at a proper timing even when the temperature changes.

The timing of applying the residual vibration suppressing pulse Ps is thus changed depending on the environmental temperature (ambient temperature) of the apparatus. This enables the residual vibration after droplet ejection to be reliably suppressed even when the ink viscosity changes depending on the ambient temperature. Accordingly, defects such as ejection curving and ink leakage from the nozzle during the subsequent droplet ejection can be prevented from occurring.

Figure 17:
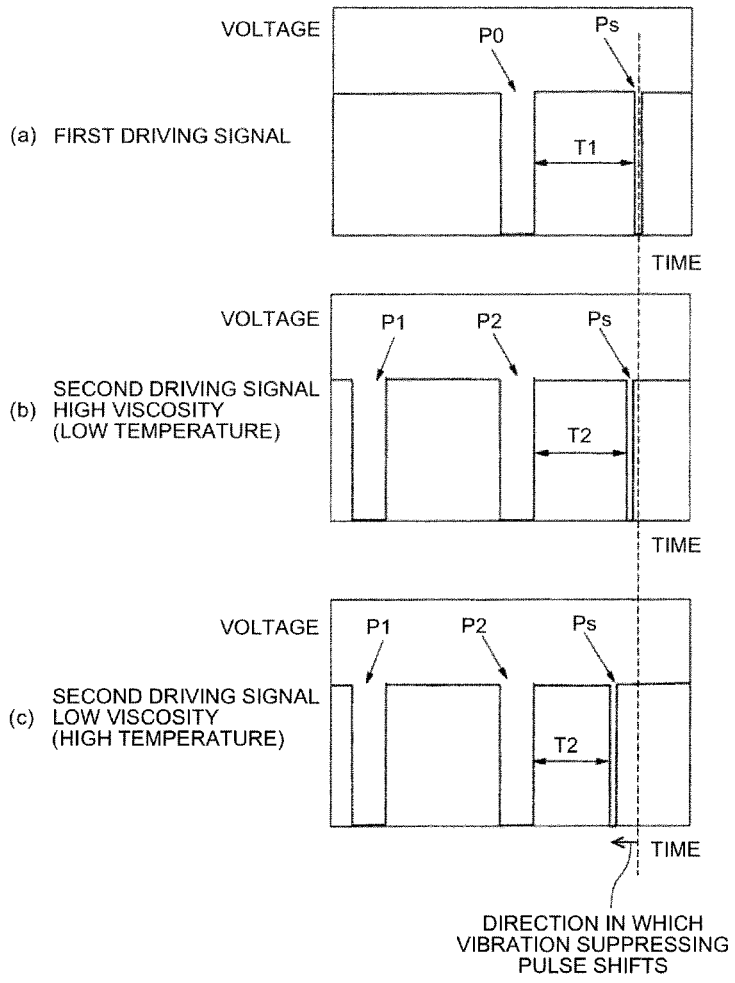
FIG. 17 is an explanatory graph of the relation between the interval of a plurality of driving pulses and a phase change direction depending on the viscosity of liquid.
Figure 18:
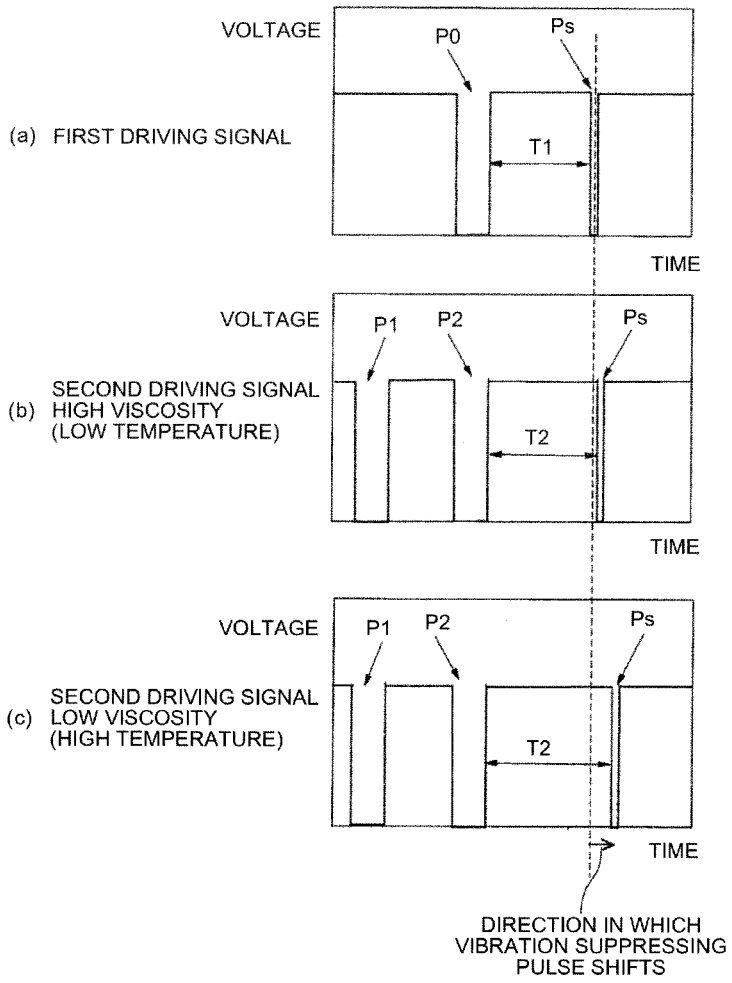
FIG. 18 is also an explanatory graph of the relation between the interval of the driving pulses and the phase change direction depending on the viscosity of liquid.

The following describes the relation between the intervals of a plurality of driving pulses and a phase change direction depending on the viscosity of liquid with reference to FIGS. 17 and 18.

As illustrated in FIGS. 17(*a*) and 18(*a*), a first driving signal composed of a single driving pulse PC for ejecting a liquid droplet and the residual vibration suppressing pulse Ps is output, and the interval between the single driving pulse PC and the residual vibration suppressing pulse Ps is indicated as a time T1.

As illustrated in FIGS. 17(*b*), 17(*c*), 18(*b*), and 18(*c*), a second driving signal composed of the first driving pulse P1 and the second driving pulse P2 (or three or more driving pulses) that are mentioned above and the residual vibration suppressing pulse Ps is output. The interval from the end of the second driving pulse P2 that is the last driving pulse here to the residual vibration suppressing pulse Ps is designated as a time T2. Here, the waveform of the single driving pulse P0 of the first driving signal is assumed to be the same as that of the last driving pulse P2 of the second driving signal.

Further, the timing of the single driving pulse P0 of the first driving signal is assumed to be the same as that of the second driving pulse of the second driving signal.

When the phase of the residual vibration due to the second driving pulse P2 of the second driving signal is shifted backward as illustrated in FIG. 10, the timing of the residual vibration suppressing pulse Ps is shifted forward from the timing of the residual vibration suppressing pulse Ps of the first driving signal, as illustrated in FIGS. 17(*b*) and 17(*c*).

The shifting amount, in the forward direction, of the timing of the residual vibration suppressing pulse Ps of the first driving signal at a low liquid viscosity (at a high environmental temperature) in FIG. 17(*c*), is larger than that at a high liquid viscosity (at a low environmental temperature) in FIG. 17(*b*).

In contrast, when the phase of the residual vibration due to the second driving pulse P2 of the second driving signal is shifted forward as illustrated in FIG. 11, the timing of the residual vibration suppressing pulse Ps is shifted backward from the timing of the residual vibration suppressing pulse Ps of the first driving signal, as illustrated in FIGS. 18(*b*) and 18(*c*).

The shifting amount, in the forward direction, of the timing of the residual vibration suppressing pulse Ps of the first driving signal at a low liquid viscosity (at a high environmental temperature) in FIG. 18(*c*), is larger than that at a high liquid viscosity (at a low environmental temperature) in FIG. 18(*b*).

This means as follows. T1 denotes the time from the end of the driving pulse P0 to the application of the residual vibration suppressing pulse Ps in the first driving signal. T2 denotes the time from the end of the last driving pulse P2 to the application of the residual vibration suppressing pulse Ps in the second driving signal. The residual vibration suppressing pulse Ps is applied so that the absolute value of the difference between the time T1 and the time T2 increases with decrease in the viscosity of liquid to be ejected (increase in the environmental temperature of the apparatus).

This allows the residual vibration suppressing pulse to be applied at a proper timing even when the viscosity of liquid to be ejected is changed. As a result, the residual vibration after droplet ejection can be suppressed reliably to prevent defects from occurring such as ejection curving and ink overflow from the nozzle during the subsequent droplet ejection.

In the present application, the material of the "sheet" is not limited to paper. The "sheet" includes an overhead projector (OHP), cloth, glass, and a substrate and means an object to which ink droplets or other liquids can adhere. The "sheet" includes those called a medium to be recorded, a recording medium, a recording chart, recording paper, or similar names. Image formation, recording, typing, imaging, and printing are all synonyms.

The "image forming apparatus" means an apparatus that forms an image by ejecting liquid onto a medium such as paper, thread, fiber, cloth, leather, metal, plastic, glass, wood, and ceramics. The "image formation" means not only producing an image indicating a character, a graphic, or other figures on a medium but also producing an image having no meaning such as a pattern (simply dropping droplets onto a medium).

The "ink" is not limited to those called ink unless it is particularly limited and is used as a generic name for all liquids with which an image can be formed, such as a recording liquid, a liquid for fixing treatment, and a fluid. The "ink" includes a deoxyribonucleic acid (DNA) sample, a resist, a patterning material, and a resin.

The "image" is not limited to a plane image and includes an image produced on a three-dimensionally formed object, and an image formed by three-dimensionally modeling a three-dimensional object.

The image forming apparatus includes any of a serial type image forming apparatus and a line type image forming apparatus unless it is particularly limited.

The embodiment enables residual vibration to be suppressed effectively even when a single dot is formed by ejecting a plurality of droplets.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a liquid ejecting head including a nozzle that ejects a droplet and a pressure producing unit that produces pressure to pressurize a pressure chamber communicating with the nozzle; and a head drive controlling unit that provides a driving signal to the pressure producing unit of the liquid ejecting head to drive the liquid ejecting head, wherein the head drive controlling unit outputs the driving signal including at least a first driving pulse and a second driving pulse to eject droplets and a residual vibration suppressing pulse to suppress residual vibration in the pressure chamber without ejecting a droplet, and the residual vibration suppressing pulse is output at such a timing that the residual vibration suppressing pulse has an opposite phase to a composite vibration Vab that is formed by superposition of a meniscus vibration Va generated by droplet ejection with the first driving pulse and a meniscus vibration Vb generated by droplet ejection with the second driving pulse, and wherein when a phase of the meniscus vibration Vb is behind a phase of the meniscus vibration Va by $\alpha 1$ ($0 \leq \alpha 1 \leq Tc/2$), and a phase of the composite vibration Vab is behind the phase of the meniscus vibration Va by $\beta 1$ ($0 \leq \beta 1 \leq Tc/2$), a time from a time point Tr2 to a time point Ts satisfies $(5/4)Tc+\beta 1-\alpha 1$ where Tr2 denotes a rising time point of the second driving pulse, Ts denotes a middle time point from a starting time point to an ending time point of the residual vibration suppressing pulse, and Tc denotes a natural vibration period Tc in the pressure chamber.

2. The image forming apparatus according to claim 1, wherein a pulse width of the residual vibration suppressing pulse is equal to or less than 1/3 of a natural vibration period Tc in the pressure chamber.

3. The image forming apparatus according to claim 1, wherein a timing of applying the residual vibration suppressing pulse is changed depending on a viscosity of liquid to be ejected or an environmental temperature of the image forming apparatus.

4. An image forming apparatus comprising:

a liquid ejecting head including a nozzle that ejects a droplet and a pressure producing unit that produces pressure to pressurize a pressure chamber communicating with the nozzle; and a head drive controlling unit that provides a driving signal to the pressure producing unit of the liquid ejecting head to drive the liquid ejecting head, wherein the head drive controlling unit outputs the driving signal including at least a first driving pulse and a second driving pulse to eject droplets and a residual vibration suppressing pulse to suppress residual vibration in the pressure chamber without ejecting a droplet, and the residual vibration suppressing pulse is output at such a timing that the residual vibration suppressing pulse has an opposite phase to a composite vibration Vab that is formed by superposition of a meniscus vibration Va generated by droplet ejection with the first driving pulse and a meniscus vibration Vb generated by droplet ejection with the second driving pulse, and wherein when a phase of the meniscus vibration Vb is ahead of a phase of the meniscus vibration Va by $\alpha 2$ ($0 < \alpha 2 \leq Tc/2$) and a phase of the composite vibration Vab is ahead of the phase of the meniscus vibration Va by $\beta 2$ ($0 < \beta 2 \leq Tc/2$), a time from a time point Tr2 to a time point Ts satisfies $(5/4)Tc+\alpha 2-\beta 2$ where Tr2 denotes a rising time point of the second driving pulse, Ts denotes a middle time point from a starting time point to an ending time point of the residual vibration suppressing pulse, and Tc denotes a natural vibration period Tc in the pressure chamber.

5. The image forming apparatus according to claim 4, wherein a pulse width of the residual vibration suppressing pulse is equal to or less than 1/3 of a natural vibration period Tc in the pressure chamber.

6. The image forming apparatus according to claim 4, wherein a timing of applying the residual vibration suppressing pulse is changed depending on a viscosity of liquid to be ejected or an environmental temperature of the image forming apparatus.

7. An image forming apparatus comprising:

a liquid ejecting head including a nozzle that ejects a droplet and a pressure producing unit that produces pressure to pressurize a pressure chamber communicating with the nozzle; and a head drive controlling unit that provides a first driving signal and a second driving signal to the pressure producing unit of the liquid ejecting head to drive the liquid ejecting head, wherein the head drive controlling unit outputs the first driving signal including a single driving pulse for ejecting a droplet and a residual vibration suppressing pulse for suppressing a residual vibration in the pressure chamber without ejecting a droplet, and the second driving signal including at least a plurality of driving pulses for ejecting droplets and the residual vibration suppressing pulse for suppressing a residual vibration in the pressure chamber without ejecting a droplet, a waveform of the single driving pulse of the first driving signal is same as a waveform of the last driving pulse of the second driving signal, and when T1 denotes a time from an end of the driving pulse of the first driving signal to application of the residual vibration suppressing pulse, and T2 denotes a time from an end of the last driving pulse of the second driving signal to application of the residual vibration suppressing pulse, an absolute value of a difference between the time T1 and the time T2 increases with decrease in a viscosity of liquid to be ejected or increase in an environmental temperature of the image forming apparatus, and wherein when the time T2 from an end of the last driving pulse of the second driving signal to application of the residual vibration suppressing pulse is shorter than the time T1 from an end of the driving pulse of the first driving signal to application of the residual vibration suppressing pulse, the higher the environmental temperature is, the earlier the residual vibration suppressing pulse of the second driving signal is applied, such that the absolute value of the difference between the time T1 and the time T2 increases, and when the time T2 is longer than the time T1, the higher the environmental temperature is, the later the residual vibration suppressing pulse of the second driving signal is applied, such that the absolute value of the difference between the time T1 and the time T2 increases.

* * * * *